US005216955A

United States Patent [19]

Pettersson

[11] Patent Number: 5,216,955

[45] Date of Patent: Jun. 8, 1993

[54] APPARATUS FOR ADJUSTING THE ACCOMODATION VOLUME OF A WORKPIECE CARRIER

[75] Inventor: Leif Pettersson, Malmo, Sweden

[73] Assignee: Tetra Pak Holdings S.A., Pully, Switzerland

[21] Appl. No.: 825,933

[22] Filed: Jan. 27, 1992

[30] Foreign Application Priority Data

Feb. 6, 1991 [DE] Fed. Rep. of Germany ..... 4103479

[51] Int. Cl.[5] ..... B65G 17/32; B65B 59/00

[52] U.S. Cl. ..... 104/89; 104/307; 901/7

[58] Field of Search ..... 414/222, 392, 395, 396, 414/585, 609; 901/1, 7; 104/307, 89; 198/803.01, 803.11, 473.1; 105/148

[56] References Cited

U.S. PATENT DOCUMENTS

| | | | |
|---|---|---|---|
| 3,608,701 | 9/1971 | Dieter | 198/189 |
| 4,203,696 | 5/1980 | Lindberg | 414/609 |
| 4,634,333 | 1/1987 | Butterly et al. | 414/609 |
| 4,636,137 | 1/1987 | Lemelson | 901/1 |
| 4,923,054 | 5/1990 | Ohtani et al. | 414/609 |
| 5,085,553 | 2/1992 | Bouwens et al. | 901/7 |
| 5,104,277 | 4/1992 | Bullock | 414/222 |

FOREIGN PATENT DOCUMENTS

| | | |
|---|---|---|
| 0273798 | 7/1988 | European Pat. Off. . |
| 2658014 | 6/1978 | Fed. Rep. of Germany . |
| 3412575 | 10/1985 | Fed. Rep. of Germany . |
| 3538993 | 4/1987 | Fed. Rep. of Germany . |
| 3618971 | 4/1987 | Fed. Rep. of Germany . |
| 3632691 | 4/1988 | Fed. Rep. of Germany . |
| 410757 | 10/1966 | Switzerland . |

*Primary Examiner*—Mark T. Le
*Attorney, Agent, or Firm*—Paul & Paul

[57] ABSTRACT

Apparatus for the adjustment of the accommodation volume of a workpiece carrier supported on a line. A bottom plate is disposed in the side walls of the workpiece carrier and is loosely displaceable at different heights within the workpiece carrier to provide a different volume for the carrier, there being provided a positioner for picking-up and moving a plate to different level within a workpiece carrier.

9 Claims, 4 Drawing Sheets

APPARATUS FOR ADJUSTING THE ACCOMODATION VOLUME OF A WORKPIECE CARRIER

BACKGROUND OF THE INVENTION

The invention relates to an apparatus for adjusting the accommodation volume of a substantially tubular workpiece carrier having side walls and supported in a line.

Widely diverse conveyor means are known for the transporting of workpieces, and in this situation the emphasis is on those conveyors where the workpiece is picked up and conveyed in a carrier supported on the conveyor line. For example and preferably, thoughts turn to liquids packagings which are indeed directly transported on conveyor belts, even without a carrier but where disposition in a workpiece carrier is preferred during their handling, particularly filling and sealing, even just for positioning purposes.

Various sizes of packages are known. For example, spirits, wine and juices are transported in relatively small packages while in some cases juice, milk, oils and water are transported in larger packages. The rough classification indicated here is intended solely to illustrate the fact that packages to hold liquids—and of course other types of contents—are filled and used with different volumes. For the manufacturer and user of an apparatus of the type mentioned at the outset, it is desirable to produce workpieces, e.g., liquids packages from paper, for different contents on the same production machine after minor adjustment operations. If a part of the production machine is a conveyor with a line on which workpiece carriers are fixed, then the workpiece carrier should be convertible from a large volume workpiece to one which has a lesser volume.

For such an adjustability of the accommodation volume of workpiece carriers, in the case of conveyor means it is already known to incorporate lifting rails along the conveyance path, so that while having the same cross-section, the workpiece carrier has maximum depth and thus maximum accommodation volume without the lifting rails. When a lifting rail is installed it can for example be adjusted to suit a shorter package, because then the bottom of this shorter package is brought by the lifting rail in the tool carrier to such a height that the top edges of the workpiece carrier and the workpiece are the same for all volumes. Such a lifting rail is indeed adjustable but cannot be used on curved portions of a conveyor, which is a drawback. Furthermore, practice has shown that three different lifting rails have to be used for three different volumes for example.

Practical experience has shown furthermore that at some processing stations in the production machine a workpiece carrier, in respect of the delivery level, has to be raised, lowered and restored to the original position. When lifting rails are used, such raising or lowering out of the datum level can only be achieved at considerable cost.

SUMMARY OF THE INVENTION

The object of the invention is so to improve an apparatus having the features mentioned at the outset that the adjustment of volume becomes possible by simple means at virtually any location a conveyor, preferably without any loss of capacity, the adjustment being made directly in the line.

According to the invention, this problem is resolved in that a bottom plate is disposed in the side walls of the workpiece carrier and is loosely displaceable in positioning means, the positioning means extending transversely to the direction of conveyance of the line and in that at least one positioner which is adapted for translatory movement at right-angles to the direction of conveyance of the line is provided, the positioner including means for picking up and moving the bottom plate.

The particular aspect of the novel invention is the adjustment of the accommodation volume of the workpiece carrier in that the height of the workpiece carrier which is available for accommodating the workpiece is altered. This alteration is made by insertion of the bottom plate which is held in a loosely displaceable fashion in the positioning means. If this bottom plate is located at the bottom of the workpiece carrier, then the maximum accommodation volume is available for the workpieces. With the pick up and displacement means of the bottom plate, it is possible to withdraw the bottom plate from its particular position in the workpiece carrier, shift it to another location by a translatory movement of the pick-up means and then insert it back again into the workpiece carrier. This very simple switch-over of the volume can be carried out directly in the line at any desired location without any loss of capacity of the conveyor plant as a whole. The means of picking up and moving the bottom plate are simple and can be variously designed.

In a preferred and special embodiment to which the present invention is not however limited, it is envisaged that the workpiece take the form of a box having substantially planar side walls and in that on at least one thrust rod extending transversely to the direction of conveyance and engaging over the line and being adapted for rectilinear reciprocating movement and/or rotation in the direction of extension, two guide plates are fixed so that they are parallel with each other and are spaced apart from one another a distance which is greater than the width of the side walls of the workpiece carrier which support the bottom plate. The bottom plate pick-up and displacement means comprises supporting forks adapted to be mounted on the positioner which comprises a positioning rod, the positioning rod extending at right-angles to the thrust rod. The guide plates are adapted for movement into and out of the region of the supporting fork, which in plan view is U-shaped.

With regard to the aforementioned embodiment, the invention relates to a box-shaped workpiece carrier having at least two substantially planar side walls. The workpiece, e.g., an empty or full liquids package made of paper, which has to be conveyed, lies between the two side walls and is exactly positioned and moved with the movement of the workpiece carrier. The workpiece, e.g., the liquids package, is generally introduced from above into the carrier in such a way that the top edge both of the carrier and also of the workpiece are at the same height. In the case of workpieces of considerable accommodation volume, which are therefore deep in the longitudinal direction of the side walls, the bottom plate which supports the workpiece from below is in a lower position. Instead of the poorly adjustable lifting rails, the invention is based on the premise that the accommodation volume of the workpiece carrier or its depth in the longitudinal direction of the side walls, which must be imagined as vertical in the case of the preferred application, is altered in that in each individual workpiece carrier a bottom plate is adjusted to various levels. It is understandable that the accommodation volume of the workpiece carrier is less when the bottom plate is at a higher level, in other words is closer to the top edge of the workpiece carrier than when the bottom plate is in the lowest possible position (maximum accommodation volume).

However, the teaching of the invention resides not only in the idea of varying the accommodation volume of the workpiece carrier by displacement of the bottom plate but is above all concerned with the means by which this bottom plate can be mechanically, and as far as possible, automatically shifted under control from one position to another. The solution proposed here is for the bottom plate to be displaced by means of two guide plates which are fixed on movable push rods. In the case of a preferred embodiment, if the position of the bottom plate is assumed to be horizontal, then the relevant guide plate must be imagined as extending at right-angles thereto, the plane of each guide plate extending parallel with the direction of conveyance.

The predetermined distance between the two guide plates makes it possible to operate the conveyor independently of the adjusting device. In other words, the workpiece carriers are moved through the adjusting device with the line, and in particular in each case one workpiece is passed through in each case one pair of guide plates. This can be regarded as the neutral position of the guide plates.

If it is desired to adjust the accommodation volume and thus to move the bottom plate from a starting position in the workpiece carrier to a midway or like position, then without any delay during shut-down of the intermittently moving conveyor, the adjusting apparatus can be engaged. Switching it on causes a movement of the push rod so that the bottom plate which is loosely held by the side walls is pushed laterally, i.e., transversely to the direction of conveyance, by whichever guide plate happens to be at the rear in the direction of thrust.

Furthermore, there is disposed on a positioning rod laterally beside the push rod, a supporting fork. The fork is provided with guide means so that the bottom plate which is pushed into the supporting fork by the rear guide plate is positioned accurately in the guide means. Displacement of the thrust rod and thus of the two guide plates occurs sufficiently far into the region of the supporting fork that the bottom plate is finally disposed completely in the supporting fork and is clear of the workpiece carrier.

As a result of the preferably vertical capability of movement of the supporting fork by means of its positioning rod, the bottom plate can now be raised or lowered to a different level in the box-like workpiece carrier. Afterwards, the push rod moves the bottom plate in the opposite direction out of the supporting fork into the positioning means in the side walls of the workpiece carrier and the accommodation volume of the workpiece carrier is thus adjusted as desired.

It will be appreciated that as a result of the measures according to the invention the bottom plate can at any desired point in a conveyor be withdrawn from the workpiece carrier by appropriate pairs of guide plates and pushed back into it again at any other location, so that adjustment of the accommodation volume is guaranteed at virtually any location on a conveyor and by simple means.

In contrast to the prior art lifting rails which are to a certain extent used in operation, adjustment of the volume can according to the invention be commenced and concluded again at any time during conveyance without any loss of capacity. Therefore, there is no need for any conveyor portion—as in the case of prior art installations—to be allowed to run empty of workpieces for the fitment of lifting rails or the like. Instead, the change-over of volume can be started at any desired point in the line and at any desired time. Without adjustment, the line with the workpiece carriers will run through the adjusting apparatus without being touched or influenced.

It will be understood that the plane of the side walls with the positioning means is preferably vertical and transversely to the direction of conveyance of the line. Then, the bottom plate can easily be pushed out by the push rod which is disposed in the manner described, adjusted in its height and pushed back again into the workpiece carrier.

The positioning means may consist of projections, shoulders, studs, strips, rails or the like protruding from the oppositely disposed surfaces of the side walls.

According to the invention, however, it is particularly preferred if pairs of opposite parallel straight grooves are provided disposed at a distance from one another in the side walls of the workpiece carrier to act as positioning means, and if the guide means of the U-shaped supporting forks are likewise grooves, the open sides of which are mutually opposite. Such a U-shaped supporting fork can be particularly rigid construction if the aforementioned positioning rod for the supporting fork is mounted on its web which connects the free arms of the U. The plane passing through the arms of the supporting fork then lies at right-angles to the positioning rod which extends vertically in a preferred embodiment. The main plane of the supporting fork is therefore horizontal, as is the bottom plate is disposed in the workpiece carrier.

If the side wall of the workpiece carrier consists of a firm material, preferably stainless steel, then it is easy to incorporate a groove as a positioning means during production. Like a furrow, such a positioning groove also has the effect of strengthening the side wall. Viewed in cross-section, the groove preferably ha a V-shape with the tip of the V pointing outward. The relevant bottom plate can then be pushed into the grooves in the oppositely disposed side walls of the workpiece carrier as into rails. Even heavy workpieces can be perfectly and precisely guides by such a bottom plate in a workpiece carrier which is so constructed.

In the case of an advantageous further development of the invention, the workpiece carrier consists of four substantially planar side walls connected to one another along the four edges of the tube which is thus formed, and provided crosswise thereto, a fixed bottom, two of the four side walls which have no positioning means being of shorter construction, a gap being left from the bottom. By the shortened form of two oppositely disposed side walls, it is possible not only to save material and to reduce the weight of the workpiece carrier but also to facilitate movement of pushing the relevant bottom plate out and in. In fact, the positioning grooves should be disposed at such a height in the two large side walls that there is no interference or blockage from the two side walls disposed transversely thereto, in other words outside the area of the shortened side walls. Alongside or beneath the shortened side walls, therefore, there is in other words formed a window which extends through the entire workpiece carrier and through which it is possible for the above-mentioned guide plates to be pushed.

It is furthermore expedient according to the invention if on or beside one of the shortened side walls there is provided, on the line, a holding plate for fixing and holding the workpiece carrier. Between this holding plate and the outer edge of the large side wall, there ought preferably to be a parallelpiped space, i.e., a space in the form of a very shallow block because in this space in the neutral position the guide plates are disposed on, or—while the conveyor is operating—pass by the workpiece carriers. This free space occurs by virtue of the fact that the supporting plate is, while parallel with the workpiece carrier, lowered to its longitudinal central position. Consequently, fitment of the workpiece carrier on the line can be accomplished in the region of its center of gravity, so that the workpiece carrier is supported substantially more strongly on the line.

It will be appreciated therefore that as a result of the envisaged development of the workpiece carrier, this is not only torsionally resistant in itself but it is also rigidly supported and that nevertheless it is possible for workpiece carriers to pass by the guide plates while the adjusting apparatus is switched off.

According to the invention, it is furthermore expedient if the bottom plate which is loosely held in the workpiece carrier is rectangular in plan view and has at least one recess extending from at least one edge towards the centre and if preferably the edge projects outwardly and is preferably of V-shaped cross-section with an outwardly pointing tip. The bottom plate can be produced from any rigid material, preferably a hard synthetic plastics because its production and friction properties are very favorable with the positioning grooves in the side walls of the workpiece carrier. According to the cross-section of the workpiece carrier which in a preferred embodiment is likewise square, the bottom plate should in plan view be of the same, in other words for example square construction.

Pushing the bottom plate into the positioning grooves in the workpiece carrier is further facilitated in that, viewed in plan, the four corners of the bottom plate are cut off so that small triangles are formed at the corners.

According to the invention, it is furthermore preferred if the bottom plate has three elongate recesses alongside one another extending from opposite edges of the bottom plate parallel with one another and beyond the bottom plate center. The recess extending from the edge into the middle portion of the bottom plate serves generally to provide a spring effect which is why the elongate recesses just described may also be termed spring grooves. In the mass operation of a workpiece production machine, in fact, pushing out of the workpiece carrier and pushing in after a change of height must take place without any tilting, jamming or the like. If, contrary to expectations, the positioning of a workpiece carrier in respect of the supporting fork or the like does not take place with sufficient accuracy, then the recess in the bottom plate will compensate for minor tolerances so that in any case the pushing of the bottom plate into or out of the workpiece carrier can be guaranteed to take place smoothly.

In a further advantageous development of the invention, it is envisaged that the line have a per se closed series of members which abut one another through end faces, in which recesses are provided for engagement with guide rails which support the members in the portions whereby on each member at least one workpiece carrier is inseparably fitted. Therefore, one can easily imagine that each member supports on its two transverse sides one workpiece carrier so that the workpiece carriers are therefore always moved in pairs in the direction of conveyance. Also in such a case, the guide plates may be fixed in pairs on the movable push rod, and in the inoperative position are disposed alongside the conveyor line so that the workpiece carriers can pass through the adjusting apparatus without hindrance; on the other hand, when the adjusting apparatus is operative, the guide plates are able to push a bottom plate out to each side and after displacement move it back again into the relevant workpiece carrier.

The adjusting apparatus according to the invention can also be used in the case of a conveying apparatus in which the line is so driven that it moves endlessly around two jockey wheels so that two straight and two curved portions are formed, the workpiece carriers being supported via the members by means of the guide rails. The guide rails support the members in the straight portions from opposite sides and in the curved portions they support it from outside. The adjusting apparatus according to the invention can be used both in the straight as well as in the curved portion of the conveyor apparatus.

The adjusting apparatus according to the invention is particularly suitable for use in the transportation or conveyance of unilaterally open tube-shaped liquids packages in a machine for producing and/or filling and/or sealing such packages. Consequently, a number of advantages can be achieved with such packaging machines, to a certain extent even simultaneously and which were not hitherto feasible completely individually or at all with the prior art conveyor means and with the adjusting means provided in those cases.

Further advantages, features and possible applications of the present invention will emerge from the ensuing description of the preferred embodiments in conjunction with the attached drawings.

DETAILED DESCRIPTION OF THE PREFERRED EMBODIMENTS

Figure 1:
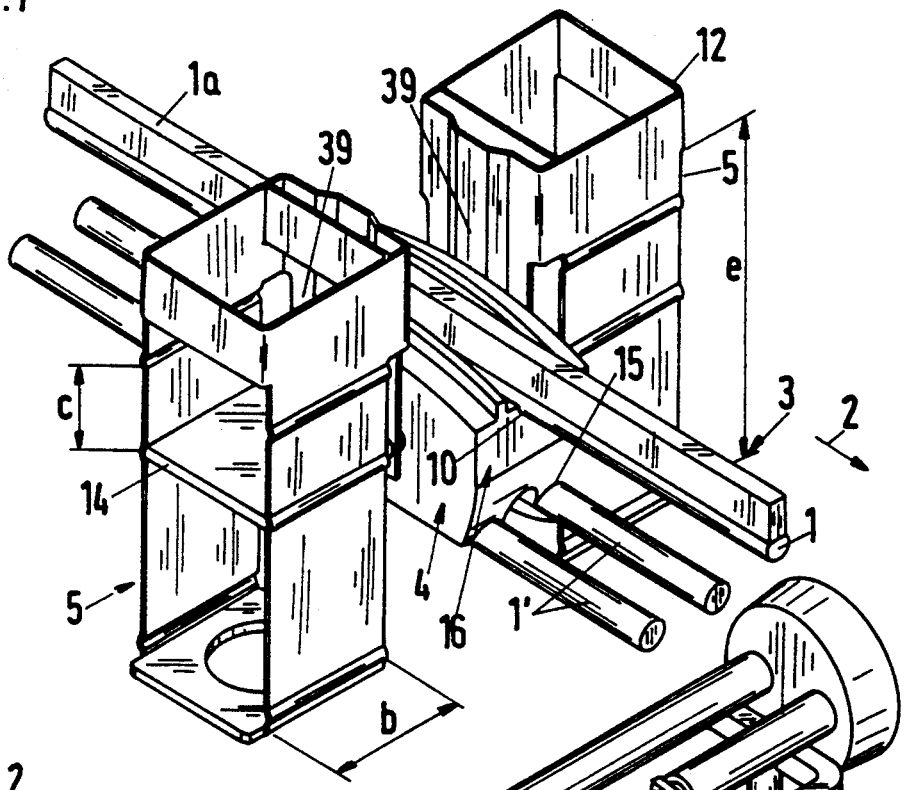
FIG. 1 is a perspective view of a member of a conveyor line supported by guide rails and having workpiece carriers fixed on both sides of the member.

A member generally designated 4 and forming part of a line 3 in which there can be a plurality of members 4 disposed one after another, is supported by outer guide rails 1 with rail reinforcements 1*a* above and 1*b* below and inner guide rails 1'. In a manner not shown here the members 4 are adjacently disposed via end faces 16 and have grooves like recesses 10 and 15 for engagement with the guide rails 1, 1' in a longitudinal direction or direction of conveyance 2. Fixed on the planar side walls 22 of members 4 above the relevant supporting plate 39 by means of bores 21 are workpiece carriers generally designated 5 which are shown in a perspective view in FIGS. 5A and 5B.

Figure 3:
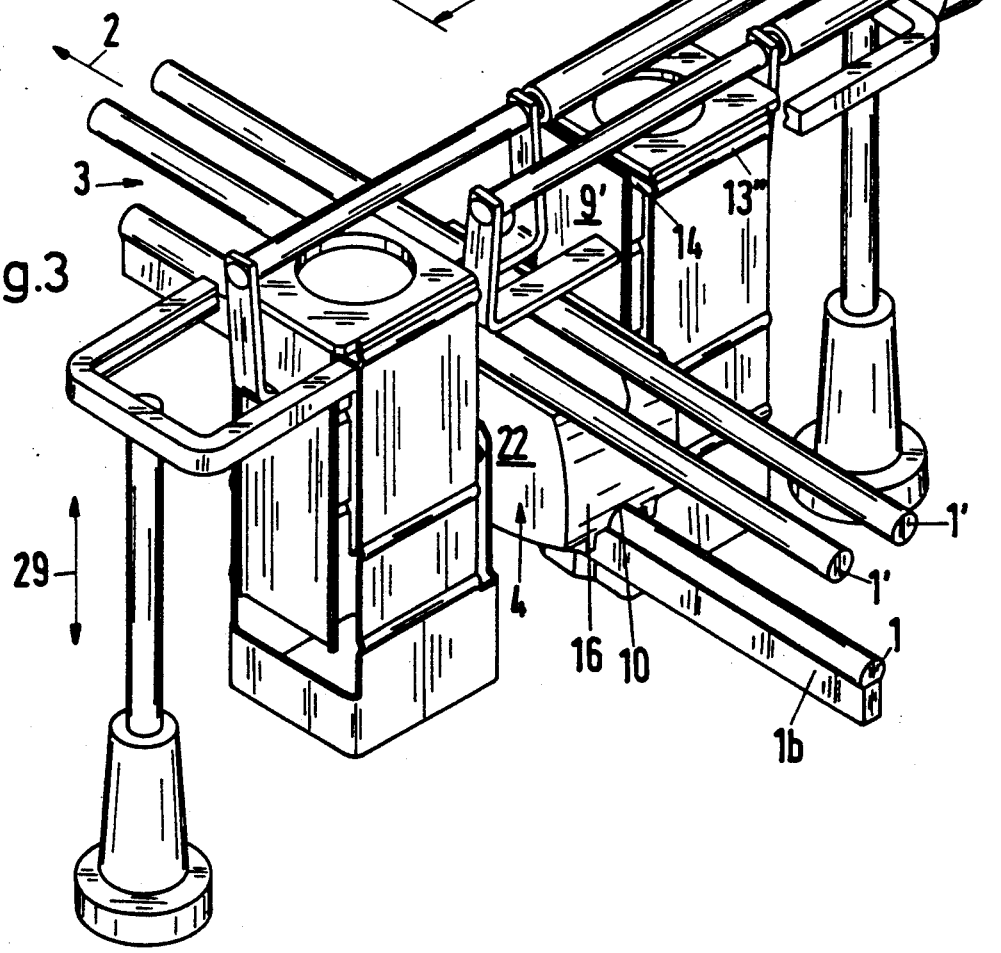
FIG. 3 is a perspective view of a combination of the parts shown in FIGS. 1 and 2, namely the inoperative position of the adjusting apparatus in FIG. 2 together with the member of the conveyor line which carries the two workpiece carriers.
Figure 4:
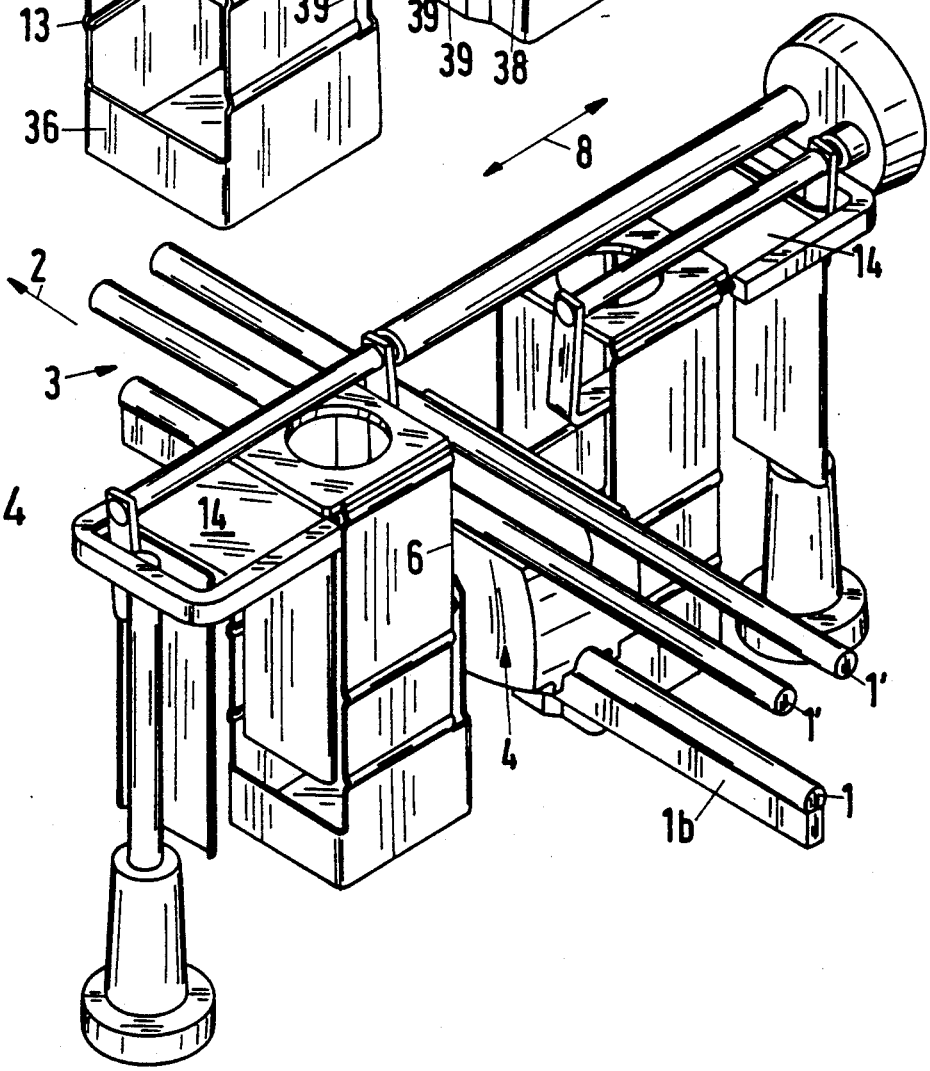
FIG. 4 is a view similar to that in FIG. 3 but in which the guide plates of the adjusting apparatus are disposed in the adjustment position with the bottom plate introduced at the top of the supporting fork.

FIG. 1 shows the conveyor direction of the transport carriers 5 with the member 4 connecting them, according to the arrow 2, rightwardly and downwardly, while in the region of the adjusting apparatus in FIG. 3 the direction of conveyance 2 is shown to be leftwardly and upwardly. This is due to the fact that FIG. 1 is a detail of the top of a straight strand of a conveyor while FIGS. 3 and 4 show a detail from the bottom of a straight conveyor portion. Therefore, the inner guide rails 1' in FIG. 1 which are disposed parallel with and beside each other are shown at the bottom in FIG. 1 and in relation to the member 4, at the top of FIGS. 3 and 4.

Figure 5A:
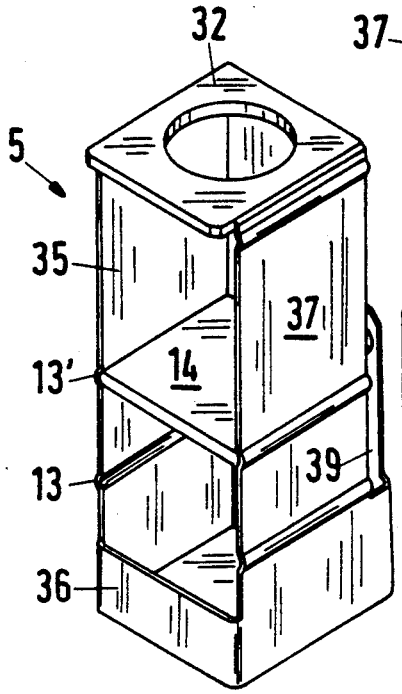
FIG. 5A and 5B are in each case perspective views of a workpiece carrier with a bottom plate in the midway position.
Figure 5B:
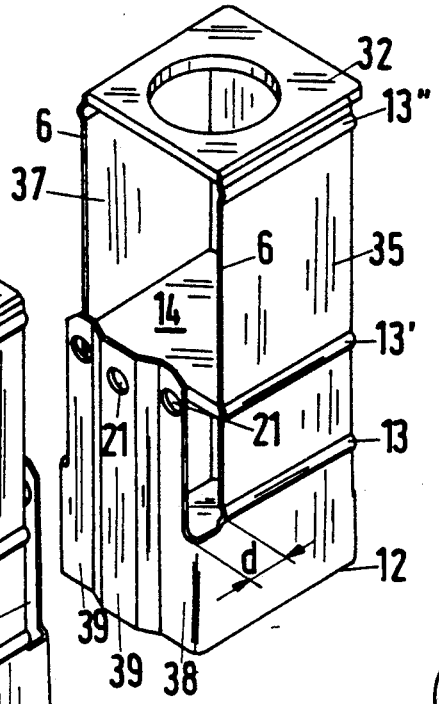

The next stage is to provide an explanation to assist with understanding the adjustment of volume of the workpiece carriers 5 shown in FIGS. 5A and 5B. It consists of four flats and side walls 35, 36, 37, 38 connected to one another along edges extending along the tube thus formed and of which the surface 38 which is towards the line is a shortened wall which may even merge into a supporting plate 39. This supporting plate 39 is at a distance d in a transverse direction (arrow 8) to the direction of conveyance 2 from the inner edge 6 of the side wall 35 or 37. This distance d is necessary so that the guide plate 9, 9' in the illustration in FIG. 3 can in the inoperative position of the adjusting apparatus be passed through alongside the tool carrier 5. At whichever is the bottom end, the workpiece carrier 5 is closed by a bottom 32 which can be seen at the top in the view shown in FIGS. 3 to 5B, because here the workpiece carrier is upside down. The hole shown in the bottom 32 serves on the one hand to save on materials and weight but it also serves to reduce the surface area on which bacteria might form and collect on a machine for producing milk cartons. It is more readily possible to spray cleaning agents or even introduce tools through this hole in order to perform jobs inside the workpiece holder 5. By means of the holes 21 in the supporting plate 39, the workpiece carrier 5 can be fixed to the relevant member, i.e. by means of bolts.

While two of the four side walls, namely the side wall 36 and the wall 38, are shortened in construction, they have disposed at right-angles thereto large side walls 35 and 37 of considerable height, namely from the bottom 32 to the top edge 12 of the workpiece carrier. At the height of the shortened side walls 36 and 38, the large side walls 35 and 37 are smooth and have no positioning grooves. But it can however be seen in FIGS. 5A and 5B, viewed from the bottom upwardly (because the workpiece carrier is upside down), that there are upper positioning grooves 13, middle grooves 13' and lower positioning grooves 13''. In consideration of the correct disposition of the workpiece carriers 5 according to the view in FIG. 1 it will be readily evident that the accommodating plate 14 is supported by the middle positioning grooves 13' (in comparison with the total volume where the displaceable supported bottom plate 14 is substantially in the lower positioning grooves 13'').

To understand the construction of the workpiece carrier 5, it can be imagined that the bottom plate 14 which is disposed loosely displaceably in the positioning grooves 13, 13', 13'' can be withdrawn by hand and pushed back in again at a different height.

The object of the adjusting apparatus however is the automatic displacement and switch-over of the bottom plate 14. This is achieved by the apparatus which is shown by itself in FIG. 2.

For easier understanding, firstly the left-hand half with the rear push rod 17 is explained. The right-hand half is constructed in a similar manner and the corresponding parts are provided with the same reference numerals but with the addition of an apostrophe. Both push rods 17, 17'are parallel with each other. Fixed at the end of the push rod 17 is a supporting angle 18 on which there is an outer guide plate 11 which is mounted parallel with the inner guide plate 9, through the supporting angle 19.

Both push rods 17, 17' are adapted for movement in the direction of the double-handed arrow 8, in other words transversely to the direction of conveyance 2 so that—and in fact the push rod 17 in the opposite direction to the push rod 17'—the pair of left-hand guide plates 9, 11 are moved leftwardly and at the same time the pair of right-hand guide plates 9', 11' are moved rightwardly. The push rods 17, 17' are supported in guide sleeves 23 and are driven by a drive device 24.

Figure 2:
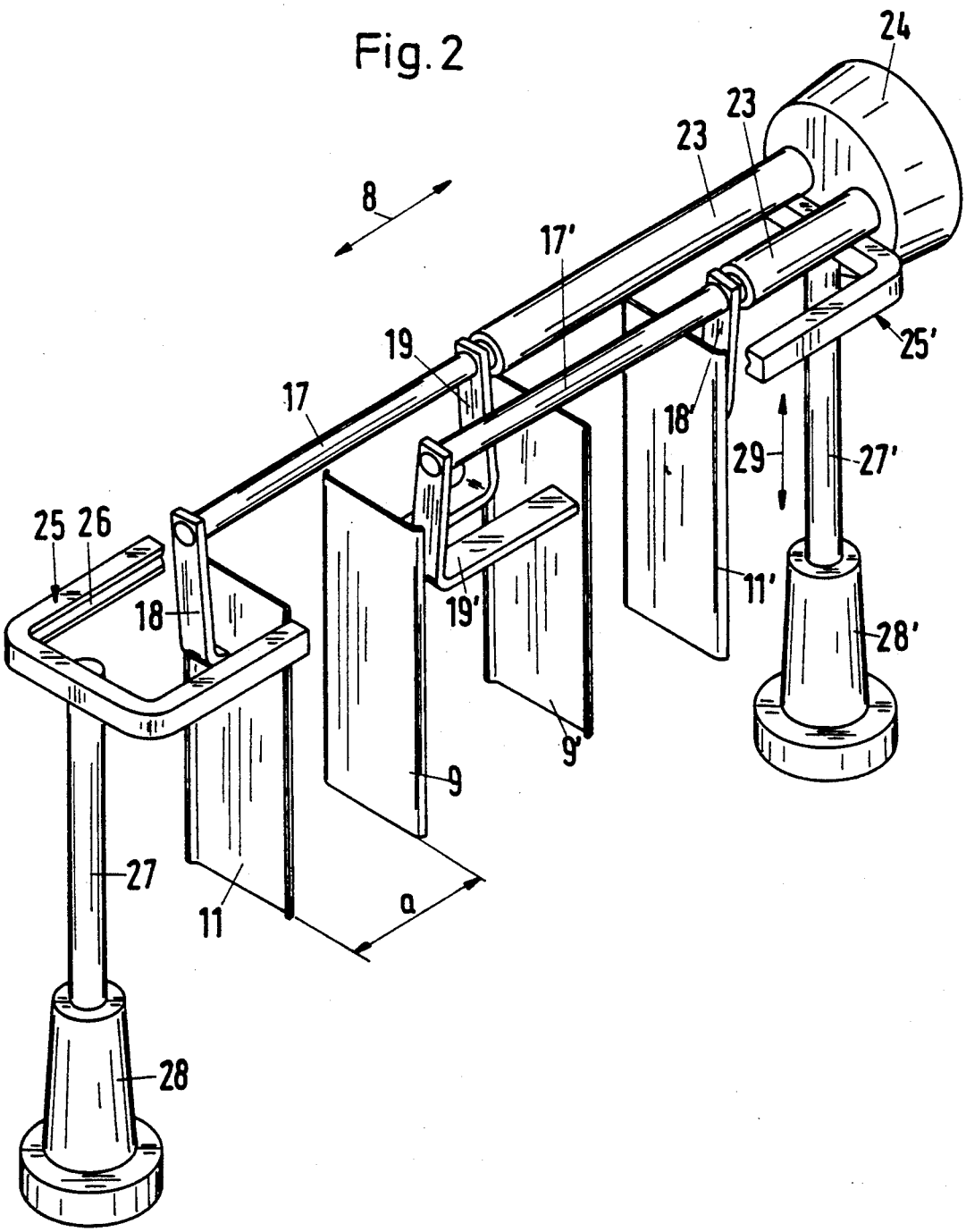
FIG. 2 shows the actual adjusting apparatus with two push rods and two pairs of guide plates so that the accommodation volume of both the workpiece carriers shown in FIG. 1 can be adjusted simultaneously.

Outside of the pair of guide plates 9, 11 or 9', 11' shown upright in the inoperative position and in FIG. 2 is a supporting fork 25, 25' in the form of a U with inwardly disposed guide grooves 26. In the middle of the web joining the two free arms of the U of the supporting fork 25 is a vertically disposed positioning rod 27 or 27' which is guided and supported in guide sleeves 28, 28'.

The positioning rods 27, 27' can be raised or lowered in a vertical direction as indicated by the double-headed arrow 29 so that when there is an adjustment of the accommodation volume the relevant bottom plate 14 can be raised to a different level of positioning grooves 13, e.g., from 13 to 13'; from 13' to 13'' or vice versa.

Figure 6:
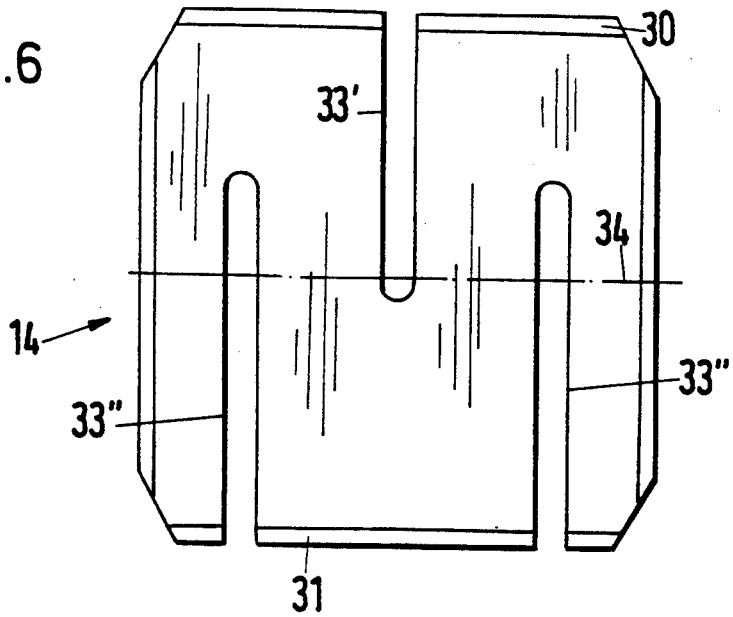
FIG. 6 is the plan view of a bottom plate.
Figure 7:
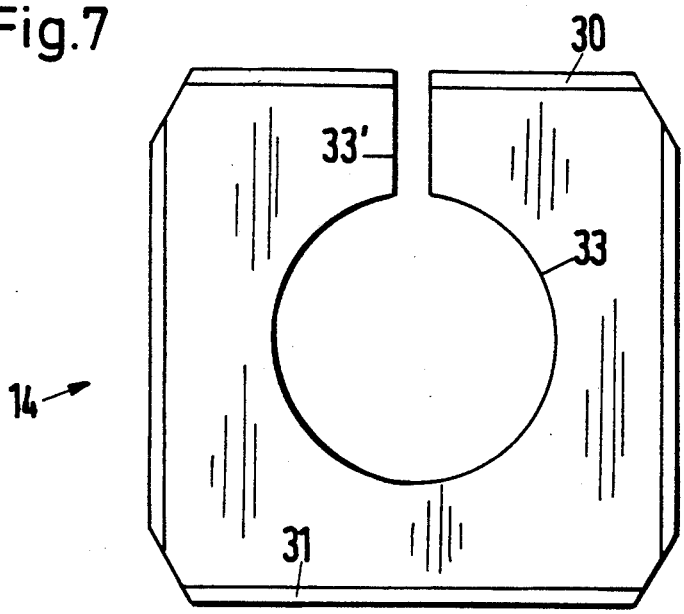
FIG. 7 is a plan view of another embodiment of bottom plate.

In a first ambodiment, the bottom plate 14 is shown in plan view in FIG. 6 and in a second embodiment it is shown in plan view in FIG. 7. The general form of the bottom plate 14 in plan view is square with cut-off corners. In the view shown in FIGS. 6 and 7, the bottom plate 14 likewise has an upper edge 30 and an oppositely disposed bottom edge 31. In the embodiment shownh in FIG. 7, there extends just from the top edge 30 to the middle of the bottom, plate 14 a recess generally designated 33 and which initially starts as an elongate recess 33' and then opens out into a circular aperature. It will be understood that the top edge 30 in the case of the embodiment of bottom plat 1 according to FIG. 7, may be shortened or opened out by bending.

In the case of the mebodiment shown in FIG. 6, there extends from the upper edge 30 just one elongate recess 30' which extends substantially towards the center. Here, there extend also from the oppositely disposed bottom edge 31 two further spaced-apart parallel elongate recesses 33'' from the bottom upwardly and even beyond the center of the bottom plate i.e., beyond the horizontal line 34 in FIG. 6.

Figure 6A:
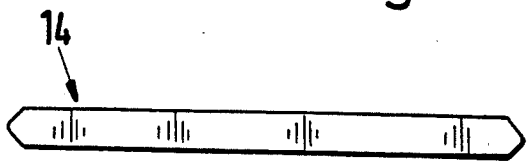
FIG. 6A is a cross-sectional view of the bottom plate.

When in the case of the view in FIGS. 6 and 7, one looks from the left to the right, then the side view of the bottom plate 14 looks as shown in FIG. 6A. The straight edges are shown as projecting outwardly and in cross-section they are V-shaped with an outwardly pointing tip.

When the adjusting apparatus is switched off, the guide plates 9, 11 or 9', 11' are in the position shown in FIG. 3 so that the workpiece carriers 5 can be passed through the adjusting apparatus in the direction of the arrow 2. It is assumed that the workpiece carriers 5 support the bottom plates 14 in the very lowest pair of positioning grooves 19''. Before switching on to reverse the bottom plates 14, the positioning rods 27, 27' are moved upwardly into the highest position in the direction of the double-headed arrow 29. Here, as is evident, are the guide grooves 26 of the supporting forks 25, 25' and they are exactly at the correct height and opposite the pair of positioning grooves 13''.

If, now the drive 24 is switched on, then the rear push rod 17 moves leftwardly and the front push rod 17' moves rightwardly, in each case in the transverse direction of the double-headed arrow 8, so that the position shown in FIG. 4 is reached. During this, the pair of guide plates 9, 11 has gripped the relevant bottom plate 14 on the left-hand side or 9', 11' on the right hand side and has pushed it out of the positioning grooves 11' and into the guide grooves 26 of the supporting forks 25, 25'. The bottom plates 14 can be displaced vertically along the guide plates 9, 11, 9', 11' downwards and upwards without interference in the direction of the double-headed arrow 29. If displacement out of the position in FIG. 4 is downwards, for example into the pair of positioning grooves 13', then it is sufficient to push back through the guide plates 9, 11 to the right 9', 11' to the left out of the position shown in FIG. 4 into that shown in FIG. 3 for the base plates 14 to be disposed in a midway position as indicated in FIGS. 5A and 5B. This is the displacement of the bottom plates by which the accommodation volume of the workpiece carrier 5 is adjusted.

I claim:

1. An apparatus for accommodating and transporting workpieces having different volumes, said apparatus comprising:

a substantially tubular workpiece carrier supported and guided along a line and having side walls and an adjustable bottom plate for supporting the workpieces, said bottom plate supported by at least two of said side walls, said at least two side walls having at least two positioning means arranged at different height levels for supporting and guiding said adjustable bottom plate along a transverse direction in relation with the line;

an adjusting means, for repositioning said bottom plate from one of said positioning means to another one of said positioning means, including a pushing means for pushing the bottom plate along said transverse direction in or out of the workpiece carrier, and a pick-up means for raising or lowering the bottom plate from the height level of one of said positioning means to the height level of another one of said positioning means, said pick-up means having guide means with a configuration corresponding to said positioning means.

2. An apparatus according to claim 1, wherein each said positioning means includes a first pair of parallel grooves on said at least two side walls; and said guide means of said pick-up means includes a second pair of parallel grooves corresponding to said first pair of grooves.

3. An apparatus according to any one of claims 1 and 2, wherein the apparatus further comprises a support member for mounting the workpiece carrier to the line.

4. An apparatus according to any one of claims 1 and 2, wherein the bottom plate is rectangular and has at least one recess extending from at least one edge towards the middle of the bottom plate; and said bottom plate is further provided with substantially V-shaped edges.

5. An apparatus according to any one of claims 1 and 2, wherein the bottom plate has three elongated recesses parallel to each other, each of said elongated recesses extending from one of the edges of the bottom plate and beyond the center of the bottom plate.

6. An apparatus according to any one of claims 1 and 2, wherein the workpiece carrier has a box-like configuration; the pushing means further comprises at least one push rod extending transversely to the line and two parallel guide plates fixedly mounted to the push rod, said guide plates being spaced from each other at a distance greater than the width of the side walls of the workpiece carrier; and the pick-up means further includes a vertical positioning rod and said guide means of said pick-up means having a generally U-shaped supporting fork member mounted on said vertical positioning rod.

7. An apparatus according to any one of claims 1 and 2, wherein the workpiece carrier comprises two short side walls and two long side walls forming a tube having a fixed bottom member.

8. An apparatus according to any one of claims 1 and 2, wherein the apparatus includes a pair of workpiece carriers arranged on both sides of the line and mounted to two sides of a support member guided along the line.

9. An apparatus according to any one of claims 1 and 2, wherein the workpiece carrier has a box-like configuration; the pushing means further comprises at least one push rod extending transversely to the line and two parallel guide plates fixedly mounted to the push rod, said guide plates being spaced from each other at a distance greater than the width of the side walls which support said bottom plate of the workpiece carrier; and the pick-up means further includes a vertical positioning rod and said guide means of said pick-up means having a generally U-shaped supporting fork member mounted on said vertical positioning rod.

* * * * *